US005376517A

United States Patent [19]

Kurachi et al.

[11] Patent Number: 5,376,517

[45] Date of Patent: Dec. 27, 1994

[54] SILVER HALIDE PHOTOGRAPHIC LIGHT-SENSITIVE MATERIAL SUBJECTED TO ANTISTATIC PREVENTION

[75] Inventors: Yasuo Kurachi; Kaoru Yaegashi; Yoichi Saito, all of Hino, Japan

[73] Assignee: Konica Corporation, Japan

[21] Appl. No.: 200,995

[22] Filed: Feb. 24, 1994

[30] Foreign Application Priority Data

Feb. 25, 1993 [JP] Japan ..... 5-036905

[51] Int. Cl.[5] ..... G03C 1/85

[52] U.S. Cl. ..... 430/527; 430/523; 430/530; 430/531

[58] Field of Search ..... 430/523, 527, 530, 531

[56] References Cited

U.S. PATENT DOCUMENTS

| | | | |
|---|---|---|---|
| 4,495,276 | 1/1985 | Takimoto et al. | 430/527 |
| 4,668,501 | 5/1987 | Shibuta et al. | 423/608 |
| 4,999,276 | 3/1991 | Kuwabara et al. | 430/527 |
| 5,045,441 | 9/1991 | Takamuki et al. | 430/527 |

FOREIGN PATENT DOCUMENTS 0143431 9/1981 Japan .

*Primary Examiner*—Thomas R. Neville
*Attorney, Agent, or Firm*—Jordan B. Bierman

[57] ABSTRACT

A silver halide light-sensitive photographic material is disclosed which comprises a support and provided thereon, a subbing layer and a silver halide emulsion layer in that order, the subbing layer containing in admixture, a binder, metal oxide particles having a volume specific resistance of not less than $10^9$ Ω cm, and a conductive polymer and the metal being selected from the group consisting of Ti, Si and Al.

8 Claims, No Drawings

SILVER HALIDE PHOTOGRAPHIC LIGHT-SENSITIVE MATERIAL SUBJECTED TO ANTISTATIC PREVENTION

FIELD OF THE INVENTION

The present invention relates to a plastic film improved in its antistatic property so as to be less affected by the change of humidity. It can be used for a magnetic tape, a floppy disk, a flexible board, a substrate for a membrane switch and a recording sheet for a printer. Since a film transparent sufficiently can be made, it can be used for an OHP film, a liquid crystal display apparatus, a touch panel and a stained glass. In addition, it can also be used for a photographic light-sensitive material because the excellent degree of clearness of the plastic film does not adversely affect the photographic characteristics of the photographic light-sensitive material.

BACKGROUND OF THE INVENTION

Because of commonly strong static charge build-up, plastic films have been hitherto often limited in their use other than the use taking advantage of such properties. For example, light-sensitive photographic materials commonly make use of plastic film as a support having electrical insulation properties. Such materials belong to what is called composite materials, comprised of a support and a light-sensitive photographic material layer. Hence the light-sensitive photographic materials tend to be statically charged when, during their manufacture and use, they come into contact with the surface of a material of the same or different kind or they are separated therefrom. Most static charges accumulated as a result of static charging cause various difficulties. The most important difficulty is what is called static marks, which are spots or branch-type or feather-type lines occurring during the photographic processing of the light sensitive photographic materials whose light-sensitive silver halide emulsion layers have been sensitized as a result of the discharge of static electricity accumulated before the photographic processing. When, for example, this phenomenon occurs in medical or industrial X-ray films, it leads to a very dangerous determination. This phenomenon becomes known only when the photographic films have been processed, and is one of very difficult problems. These accumulated static charges may also cause troubles such that dust adheres to a plastic film surface and no uniform coating on the film surface can be carried out.

Such troubles caused by static charging may also occur in many cases besides the foregoing. For example, in the course of manufacture, the troubles may be caused by contact friction between photographic films and rollers, and by separation of emulsion sides from support sides in the course of winding-up or unwinding of photographic films. In finished products, the troubles may be caused by separation of emulsion sides from base sides when photographic films are wound up and change-over is made, and by contact and separation occurring between X-ray films and machine parts during automatic photographing or between X-ray films and intensifying screens. The troubles may also be caused by contact with other packaging materials. The static marks of light-sensitive photographic materials, caused by accumulation of such static charges become remarkable with an increase in sensitivity of light-sensitive photo-graphic materials and an increase in processing speed thereof. In particular, in these days, static marks tend to occur since photographic materials have been made to have a higher sensitivity and are often handled under severe conditions such that light-sensitive coating is carried out at a higher speed, photographs are taken at a higher speed and automatic processing is carried out at a higher speed.

Moreover, in recent years, adhesion of dust to the photographic materials after photographic processing has come into question, and it is sought to make an improvement so that antistatic properties can also be retained after the processing.

The best method for eliminating such difficulties due to static is to increase electrical conductivity of materials so that static charges can be dissipated in a short time before the discharge of accumulated electricity takes place.

Accordingly, methods of improving the conductivity of supports of light-sensitive photographic materials or that of surface layers of various coatings have been hitherto proposed and it has been attempted to utilize various hygroscopic substances and water-soluble inorganic salts and certain types of surface active agents and polymers. For example, Japanese Patent Publication Open to Public Inspection [hereinafter referred to as Japanese Patent O.P.I. Publication] Nos. 91165/1974 and No. 121523/1974 disclose examples in which ion type polymers having a dissociative group in the polymer main chain are applied. Other invention is also known which relates to conductive polymers as disclosed in Japanese Patent O.P.I. Publication Nos. 9689/1990 and 182491/1990 and surface active agents as disclosed in Japanese Patent O.P.I. Publication Nos. 55541/1988, 148254/1988, 148256/1988 and 14191/1989.

These many substances, however, have a specificity depending on the types of film supports and the differences in photographic compositions and can give good results on certain types of film supports, photographic emulsions and other photographic components. They, however, not only can be of no use at all for antistatic in the case of other different types of film supports and photographic components, but also may adversely affect photographic performance. Another important disadvantage thereof is that these many substance lose their function as a conductive layer when used in an environment of low humidity.

For the purpose of preventing the deterioration of performance in an environment of low humidity, Japanese Patent Examined Publication Nos. 6616/1960 and 20735/1989 disclose techniques in which metal oxides are used as antistatic treatments. The former discloses a method in which a colloidal sol dispersion is used. The latter discloses a method in which a highly crystalline metal oxide powder having been treated at a high temperature is used so that a problem concerning conductivity in the former can be eliminated. In the latter technique, however, it is stated that, because of the use of a highly crystalline powder, its particle diameter and the ratio of particles to a binder must be taken into account as countermeasures to light scattering. Japanese Patent O.P.I. Publication No. 29134/1992 also discloses a method in which a particulate metal oxide and a fibrous metal oxide are employed as conductive materials used in light-sensitive photographic materials for the purpose of not only improving performance in an environment of low humidity but also eliminating other disadvantages. There, however, have remained a problem concerning the amount of the oxides added.

Thus, in relation to light-sensitive photographic materials provided with a layer containing conductive fine metal particles, problems have remained unsettled yet even though means for preventing the deterioration of performance in an environment of low humidity have been studied for 30 years or more since the above techniques were disclosed in Japanese Patent Examined Publication No. 6616/1960.

For example, in the case when a layer containing such conductive fine metal particles is provided adjoiningly to a silver halide layer containing silver halides, there is the problem that pressure marks or abrasion marks tend to occur in images as a result of any friction caused when light-sensitive photographic materials are handled. For another example, in the case when such particles are used as a mixture with a binder, there is the problem that fine particles present on the surface of light-sensitive photographic materials may fall as a result of any friction caused when light-sensitive photographic materials are manufactured or handled, and hence may adhere to rollers in the course of the manufacture to scratch the products being carried.

As a method for preventing the dust of metal oxide from falling and the silver halides from suffering pressure marks or abrasion marks, Japanese Patent O.P.I. Publication No. 104931/1982 discloses use of a metal oxide such as zinc oxide, stannic oxide or indium oxide in a backing layer. Since, however, metal oxides having conductivity are usually colored, fogging due to coloring may occur when contained in light-sensitive materials, to cause a great problem. According to the method disclosed in Japanese Patent O.P.I. Publication No. 104931/1982, any of these metal oxides must be used in an amount of about 1 g as described in Examples, and its coloring (dark blue) causes fog to greatly damage a photographic performance (light transmission).

SUMMARY OF THE INVENTION

Accordingly, an object of the present invention is to provide a photographic light-sensitive material subjected to antistatic prevention by the use of metal oxide particles wherein surface smoothness is not deteriorated, antistatic agents does not fall from the materials, pressure fog and scratches are not caused, transparency is excellent and high antistatic property can be kept even under a low humidity condition.

The above object of the invention has been attained by a silver halide light-sensitive photographic material comprising a support and provided thereon, a subbing layer and a silver halide emulsion layer in that order, wherein the subbing layer contains in admixture a binder, metal oxide particles having a volume specific resistance of not less than $10^9$ Ω cm, and a conductive polymer, the metal being selected from the group consisting of Ti, Si and Al.

The present invention has solved the above-mentioned problems which have so far remained undissolved by a combination use of a specific oxide particle and a specific polymer.

As known in the art, the conductivity of these metal oxide particles is exhibited by charge carriers such as cations, anions or electrons or positive holes present in the oxides. The total electrical conductivity thereof is expressed as follows:

$$\sigma t = \sigma c + \sigma a + \sigma n + \sigma p$$

wherein;

$\sigma c$ is electrical conductivity of cations;

$\sigma a$ is electrical conductivity of anions;

$\sigma n$ is electrical conductivity of electrons;

$\sigma p$ is electrical conductivity of positive holes.

When the charge carriers are mainly ions, a solid electrolyte is formed. When the charge carriers are electrons, semiconductors are formed. In usual instances, conductors comprised of a mixture of the both are formed, and non-stoichiometric compounds such as oxygen-deficient oxides, metal-excess oxides, metal-deficient oxides and oxygen-excess oxides are formed as semiconductors.

The present inventors have studied the structure and the characteristics of an amorphous material. As a result, they reached a conclusion as follows; there is a site which easily accepts an electron pair (the Lewis acid point) on the surface of oxides of Ti, Si, and Al so that ionic bondage can be formed on the surface thereof depending upon compounds used in combination. Accordingly, if a combination of specific compounds with oxides can be discovered, the interface of the both forms an electroconductive layer so that it can be used as an antistatic material. Thus, they attained the present invention.

Namely, the present inventors have discovered a silver halide photographic light sensitive material containing particles comprised of an oxide of a metal selected from the group of consisting of Ti, Si and Al and having a volume specific resistance of $10^9$ Ω.cm or more and polymer compounds having a volume specific resistance of $10^{13}$ Ω.cm or less, whereby antistatic property has been improved and optical characteristics are excellent. The volume specific resistance of the particles of the invention is preferably $10^9$ to $10^{16}$ Ω.cm.

With regard to volume specific resistance, the volume specific resistance of a large single crystal means that of the crystal itself. When a large single crystal is not obtained, the volume specific resistance of powder or particles, which is not a single crystal, means that of a material molded under a pressure from the powder or particles. When volume specific resistance is unknown, the value is represented by that obtained by dividing volume specific resistance of a material molded from powder under a specific pressure with $10^2$. There is no limitation to the value of specific pressure. However, it is preferably 10 kg/cm2 or more, and more preferably 100 kg/cm 2 or more. In general, the relation between pressure applied to powder and volume specific resistance of the molded material tends that, the higher the pressure is, the lower the volume specific resistance is. However, even when an isotropic pressure of 3 t/cm$^2$ is applied by means of a static water pressure type pressurer, a value lower than the volume specific resistance obtained in a single crystal cannot be obtained. The value becomes higher by about 100 times. Accordingly, a value of the volume specific resistance of a molded material obtained from powder by means of a specific pressure divided by $10^2$ is adopted. The volume specific resistance of the invention is a value obtained by measuring at 25° C. and 20% of a relative humidity.

In general, a semiconductor material is defined to be a material having volume a volume specific resistance of less than $10^{12}$ Ω.cm, and a conductor material is defined to be a material having a volume specific resistance of less than $10^{12}$ Ω.

The metal oxide particles of the invention may be in a form of a crystal or a non-crystal. The metal oxide particles of the invention include a compound having a perovskite structure, that is; an oxide comprising a metal selected from the group consisting of Ti, Si and Al having a perovskite structure or a crystalline porous material, for example, zeolite such as a crystalline aluminosilicate, a compound obtained by substituting Al or Si of the zeolite with Be, B, Ga, Cr, Fe, Ge, Ti or P or pearlite.

The oxide particle of the invention is preferably an oxide of a metal selected from the group consisting of Ti, Si and Al, wherein the oxide has a volume specific resistance of $10^9$ Ω.cm or more. The volume specific volume of the oxide particles is preferably $10^9$ to $10^{16}$ Ω.cm. The example of the oxide of the invention is preferably metal oxide particles comprising a metal selected from the group consisting of Ti, Si and Al.

The example of the oxide of the invention is more preferably organic metal particles of $Al_2(isoC_3H_7O)_3$, $$Ti(isoC_3H_7O)_3 \quad \text{or} \quad C_2H_5O\left(\begin{array}{c}OC_2H_5\\ |\\ Si\\ |\\ OC_2H_5\end{array}O\right)_n C_2H_5$$

or a metal oxide or complex metal oxide particles such as $Si_3Al_4O_{12}$, $TiO_2$, $Al_2O_3$ and $SiO_2$. The oxide particles of the invention has an average particle diameter is 0.005 to 10 μm, preferably 0.005 to 1 μm, and more preferably 0.005 to 0.5 μm.

Any method for synthesizing the oxide particles of the invention may be used as far as the object of the present invention can be attained by means of the conventional method. For example, a coprecipitation process, multi-stage process, sol-gel process, atomizing process or plasma thermal decomposition process that use as a starting material a transition metal or a compound containing a transition metal. Here, the transition metal or the compound containing a transition metal refers to a compound mainly composed of, depending upon a method for synthesizing powder, Ti, Al and Si and preferably a water-soluble or organic solvent-soluble compounds, as exemplified by metal alkoxydes such as $Ti(OC_3H_7)_4$ and organic metal compounds such as ferrocene. In addition, depending upon methods for synthesizing powder, it is also possible to use materials that are solid at room temperature, mainly composed of Ti, Al and Si. Thus, there are no particular limitations.

The electric characteristics of the powder whose main components are Ti, Al and Si may be an insulating or semiconductor.

The conductive polymer of the present invention is a polymer having a functional group such as a carboxylic acid, sufonic acid, amino, ketone, sulfone, ether, imido or cyano group at the side chain or a polymer having an atomic group capable of coordinating metal atoms. The ion conductive polymer having a carboxylic acid group, a sufonic acid group or an amino group at the side chain is preferable. The example thereof includes polyvinylbenzene sulfonic acid or a salt thereof or a quaternary ammonium salt such as polyvinylbenzyl trimethylammonium chloride. In addition, compounds known as electron-conductive polymers such as polyacetylene, polypyrrole, polyaniline and polyparaphenylene, and ion-conductive polymers having a polyether, polyester, polyamine and polysulfide at the basic skeleton or the side chained group are used. The electric characteristics of electroconductive polymer is not more than $10^{13}$ Ω.cm, preferably not more than $10^{11}$ Ω.cm or not more than $10^{10}$ Ω.cm and especially preferably not more than $10^{11}$ Ω.cm.

The above-mentioned metal oxidized particles and electroconductive polymer compounds are dispersed and dissolved in a binder. Or, powder wherein metal oxidized powder was subjected to surface treatment with an electroconductive polymer or micro-capsulating or a powder, after mixing in medium wherein metal oxidized powder is dissolved or dispersed in an electroconductive polymer, subjected to a spray dry method or a freezing drying method may be dispersed and coated.

The added amounts of the metal oxidized product particles and electroconductive polymer compound are explained as follows: The electroconductive polymer compound are added in an extent that does not deteriorate the physical properties such as electroconductivity. There is no limitation thereto. With regard to the added amount of metal oxidized material, it is ordinarily not more than 60%, preferably not more than 50% and especially preferably not more than 40% in terms of volume fraction. However, it is preferable as the added amount is smaller. The powder is preferably added in a volume fraction of not more than 30%. It may more preferably be in a volume fraction of not more than 20%. However, it is necessary to add in terms of a volume fraction of not less than 0.1% and preferably not less than 0.5%. Some compounds may require its addition in a volume fraction of not less than 1%. However, with regard to added amount, there is no especial limitation in the present invention.

According to this volume fraction, the amount used comes to be reduced to approximately from 0.00005 to 1 g per square meter of a light-sensitive photographic material, so that a desirable transparency and a higher antistatic can be achieved. Hence the electroconductive material can be obtained and the pressure marks and abrasion marks can be prevented from occurring when light-sensitive photographic materials are handled.

There are no particular limitations on the binder used in the present invention so long as it is capable of forming a film. For example, the binder may include proteins such as gelatin and casein, cellulose compounds such as carboxymethyl cellulose, hydroxyethyl cellulose, acetyl cellulose, diacetyl cellulose and triacetyl cellulose, saccharides such as dextran, agar, sodium alginate and starch derivatives, and synthetic polymers such as polyvinyl alcohol, polyvinyl acetate, polyacrylates, polymethacrylates, polystyrene, polyacrylamide, poly-N-vinyl pyrrolidone, polyester, polyvinyl chloride and polyacrylic acid.

In particular, it is preferred to use gelatin such as lime-treated gelatin, acid-treated gelatin, enzymolyzed gelatin, phthalated gelatin or acetylated gelatin, acetyl cellulose, diacetyl cellulose, triacetyl cellulose, polyvinyl acetate, polyvinyl alcohol, polybutyl acrylate, polyacrylamide, or dextran.

As a dispersion method of a conductive substance or semiconductor grains into a binder, a method to utilize free rotation movement, a method to utilize hindrance movement inside a vessel provided with a hindrance plate, a method to utilize tilting movement wherein a sealed vessel is rotated around the horizontal axis, a method to shake a vessel upward and downward and a method to utilize cutting strength on a roll. Any method may be chosen as far as not preventing the object of the present invention. It is preferable, in one of these method, to mix a conductive substance or semiconductor grains. For example, a method to utilize rotation movement wherein grains having a size of 0.1 mm or larger and a method using a sand grinder are cited.

The support that can be used in the present invention may include, for example, cellulose nitrate film, cellulose acetate film, cellulose acetate butyrate film, cellulose acetate propionate film, polystyrene film, polyethylene terephthalate film and polycarbonate film, as well as laminates of any of these.

These supports may be appropriately selected from transparent supports and opaque supports according to the purpose for which light-sensitive photographic materials are used. The transparent supports are not limited to only colorless transparent ones, and may be colored transparent ones to which a dye or a pigment has been added.

A polyol compound such as ethylene glycol, propylene glycol or 1,1,1-trimethylol propane may also be added to the protective layer or other layer of the present invention. Its addition can bring about a more preferable antistatic effect.

The light-sensitive material according to the present invention may include various light-sensitive materials including usual black and white light-sensitive silver halide photographic materials as exemplified by black and white light-sensitive materials f or photographing, X-ray black and white light-sensitive materials and black and white light-sensitive materials for printing, and usual multi-layer color light-sensitive materials as exemplified by color reversal films, color negative films and color positive films. In particular, the present invention is greatly effective for high-temperature processing light-sensitive silver halide photographic materials and high-speed light-sensitive silver halide photographic materials.

The light-sensitive silver halide photographic material according to the present invention will be briefly described below.

The binder used in the photographic layers may include proteins such as gelatin and casein, cellulose compounds such as carboxymethyl cellulose, hydroxyethyl cellulose and dextran, sugar derivatives such as agar-agar, sodium alginate and starch derivatives , and synthetic hydrophilic colloids as exemplified by polyvinyl alcohol, poly-N-vinyl pyrrolidone, polyacrylic acid copolymers, polyacrylamide, or derivatives or partially hydrolyzed products of these, which can be used in combination.

The gelatin herein noted refers to what is called lime-treated gelatin, acid-treated gelatin or enzymolyzed gelatin.

To the photographic component layers of the present invention, other known surface active agents may also be added alone or in the form of a mixture. They are used as coating aids, and in some instances also used for other purposes, e.g., for emulsification dispersion, sensitization and improvement of other photographic performances.

Invention may contain in its photographic component layers the polymer latex disclosed in U.S. Pat. No. 3,411,911.

Silver halide grains in emulsions may be those having a regular crystal form such as a cube or an octahedron, or may be those having irregular crystal form such as a sphere, a plate or a potato or those having a composite form of any of these crystal forms. They may also be comprised of a mixture of grains having various crystal forms. Tabular grains having a grain diameter five time s or larger than grain thickness can be preferably used in the present invention.

In the present invention, light-sensitive silver halide emulsions may be used in the form of a mixture of two or more silver halide emulsions. The emulsions mixed may be different in their particle size, halogen composition, sensitivity and so forth. A substantially non-sensitive emulsion may be mixed in a light-sensitive emulsion, or may be separately used in a separate layer. For example, a light-sensitive emulsion comprising spherical or potatolike grains and a light-sensitive silver halide emulsion comprising tabular grains having a grain diameter five times or larger than grain thickness may be used in the same layer or in different layers. When used in different layers, the light-sensitive silver halide emulsion comprising tabular grains may be present at the side near to the support or on the other hand may be present at the side distant therefrom.

EXAMPLE

Next, the present invention are explained referring to examples. However, the present invention is not limited thereby.

Powder P1

After mixing 30 g of ethyl silicate 28, 30 g of aluminum isopropoxide, 50 cc of ethanol and 50 cc of water completely by a high speed mixer, 10 g of polyvinyl benzene sulfonate was added to the mixture. The resulting solution was further mixed in the mixer. The resulting sol was sprayed and dried by means of a spray dry method and collected as powder. The volume specific resistance of P1 was $10^7$ Ω.cm.

Powder P2

After mixing 30 g of ethyl silicate 28, 30 g of aluminum isopropoxide and 50 cc of ethanol completely, toluene sulfonate was added to the mixture. The resulting solution was mixed in a high speed mixer to obtain a sol solution. The resulting sol was collected by filtering. The resulting sol was burned at 300° C. The volume specific resistance of P2 was $10^{13}$ Ω.cm.

EXAMPLE 1

Preparation of Support

To both sides of a polyethylene terephthalate film having a thickness of 100 μm after biaxial stretching and thermal fixing, corona discharging was applied at 8 W min/m$^2$. The film thus treated was coated on one side thereof with the following subbing coating solution B-1 as described in Japanese Patent O.P.I. Publication No. 19941/1984, so as to form subbing layer B-1 having a dried coating thickness of 0.8 μm, by drying at 100° C. for 1 minute. The polyethylene terephthalate film was further coated on the side opposite to subbing layer B-1 side with the following subbing coating solution B-2 as described in Japanese Patent O.P.I. Publication No. 77439/1984, so as to form subbing layer B-2 having a dried coating thickness of 0.8 μm by drying at 100° C. for 1 minute.

First Subbing Layers

Subbing Coating Solution B-1

Copolymer latex solution comprised of 30% by weight of butyl acrylate, 20% by weight of t-butyl acrylate, 25% by weight of styrene and 25% by weight of 2-hydroxyethyl acrylate

| | |
|---|---|
| (solid content: 30%) | 270 g |
| Compound A | 0.6 g |
| Hexamethylene-1,6-bis(ethyleneurea) | 0.8 g |

Made up to 1 liter by adding water.

Subbing Coating Solution B-2

Copolymer latex solution comprised of 40% by weight of butyl acrylate, 20% by weight of styrene and 40% by weight of glycidyl acrylate

| | |
|---|---|
| (solid content: 30%) | 270 g |
| Compound A | 0.6 g |
| Hexamethylene-1,6-bis(ethyleneurea) | 0.8 g |

Made up to 1 liter by adding water.

Second subbing layer

To the above subbing layers B-1 and B-2, corona discharging was applied at 8 W min/m2 , and the following coating solution B -3 was coated thereon so as to give a dried coating thickness of 0.1 μm each, by drying at 100° C. for 1 minute.

Subbing Coating Solution B-3

| | |
|---|---|
| Gelatin | 10 g |
| Compound A | 0.4 g |
| Compound B | 0.1 g |
| Silica particles with an average particle diameter of 3 μm | 0.1 g |
| Polyvinyl benzene sulfonate | 3 g |
| Powder P1 | 15 g |

Made up to 1 liter by adding water.

Compound A

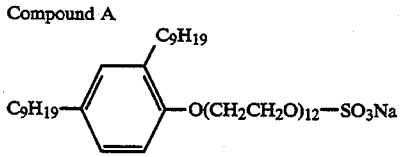

Compound B

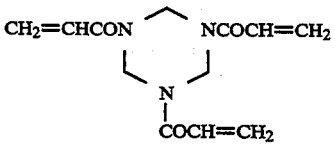

Preparation of Emulsion

In an acidic atmosphere of pH 3.0, grains containing rhodium in an amount of $10^{-5}$ mol per mol of silver was produced by controlled double-jet precipitation. The grains were grown in a system containing benzyladenine in an amount of 30 mg per liter of an aqueous 1% gelatin solution. After silver and halide were mixed, 6-methyl-4-hydroxy-1,3,3a,7-tetrazaindene was added in an amount of 600 mg per mol of silver halide, followed by washing to carry out desalting.

Subsequently, 6-methyl-4-hydroxy-1,3,3a,7-tetrazaindene was added in an amount of 60 mg per mol of silver halide, and thereafter sulfur sensitization was carried out. After the sulfur sensitization was completed, 6-methyl-4-hydroxy-1,3,3a,7-tetrazaindene was added as a stabilizer.

Silver Halide Emulsion Layer

To the above emulsion, additives were added so as to give the following coating weights, and the emulsion thus prepared was coated on the support described above.

| | |
|---|---|
| Latex polymer: | |
| Styrene/butyl acrylate/acrylic acid terpolymer | 1.0 g/m2 |
| Tetraphenylphosphonium chloride | 30 mg/m$^2$ |
| Saponin | 200 mg/m$^2$ |
| Polyethylene glycol | 100 mg/m$^2$ |
| Sodium dodecylbenzenesulfonate | 100 mg/m$^2$ |
| Hydroquinone | 200 mg/m$^2$ |
| Phenidone | 100 mg/m$^2$ |
| Styrene sodium sulfonate/maleic acid copolymer (Mw: 250,000) | 200 mg/m$^2$ |
| Butyl gallate | 500 mg/m$^2$ |
| Tetrazolium compound (described below) | 20 mg/m$^2$ |
| 5-Methylbenzotriazole | 30 mg/m$^2$ |
| 2-Mercaptobenzimidazole-5-sulfonic acid | 30 mg/m$^2$ |
| Inert ossein gelatin (isoelectric point: 4.9) | 1.5 g/m$^2$ |
| 1-(p-Acetylamidophenyl)-5-mercaptotetrazole | 30 mg/m$^2$ |
| Silver weight | 2.8 g/m$^2$ |

Tetrazolium compound

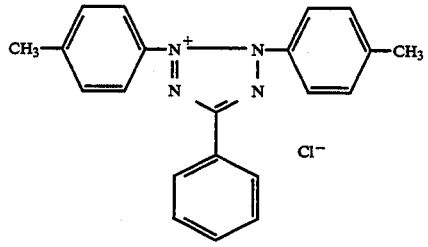

Emulsion Layer Protective Layer

To form an emulsion layer protective layer, a coating solution was prepared so as to give the following coating weights, and coated.

| | |
|---|---|
| Fluorinated dioctylsulfosuccinate | 300 mg/m$^2$ |
| Matting agent: Polymethyl methacrylate (average particle diameter: 3.5 μm) | 100 mg/m$^2$ |
| Lithium nitrate | 30 mg/m$^2$ |
| Acid-treated gelatin (isoelectric point: 7.0) | 1.2 g/m$^2$ |
| Colloidal silica | 50 mg/m$^2$ |
| Styrene sodium sulfonate/maleic acid copolymer | 100 mg/m$^2$ |
| Mordant | 30 mg/m$^2$ |

-continued

| Dye | 30 mg/m$^2$ |
|---|---|

Mordant

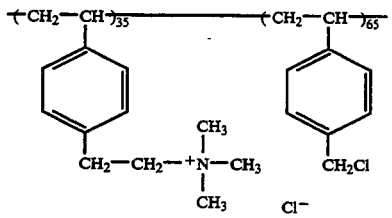

Dye

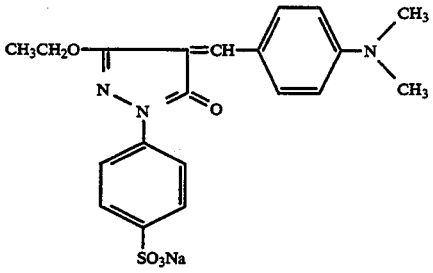

Backing Layer

The support was coated on the side opposite to the emulsion layer side with the following backing dye solution. The gelatin layer was hardened using glyoxal, 1-oxy-3,5-dichloro-S-triazine sodium salt and a hydroxy-containing epoxy compound (d).

| | |
|---|---|
| Hydroquinone | 100 mg/m$^2$ |
| Phenidone | 30 mg/m$^2$ |
| Latex polymer: | |
| Butyl acrylate/styrene copolymer | 0.5 g/m$^2$ |
| Styrene/maleic acid copolymer | 100 mg/m$^2$ |
| Citric acid | 40 mg/m$^2$ |
| Benzotriazole | 100 mg/m$^2$ |
| Styrene sulfonic acid/maleic acid copolymer | 100 mg/m$^2$ |
| Lithium nitrate | 30 mg/m$^2$ |
| Backing dye (a), (b) and (c) | 40 mg/m$^2$, 30 mg/m$^2$ and 30 mg/m$^2$, respectively |
| Ossein gelatin | 2.0 g/m$^2$ |

Backing dye (a)

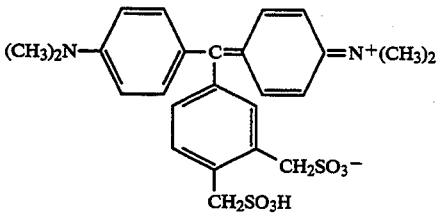

Backing dye (b)

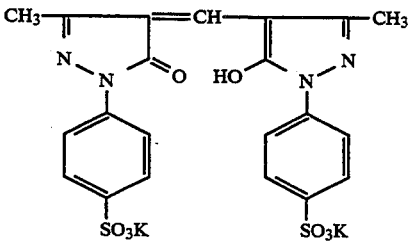

Backing dye (c)

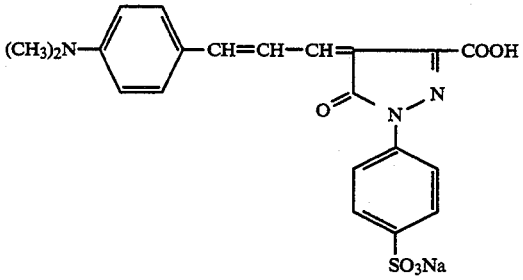

Epoxy compound (d)

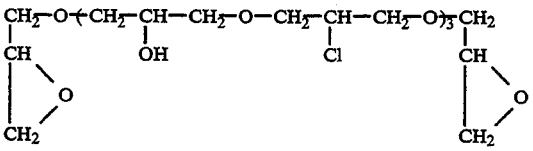

The sample obtained in the manner as described above was subjected to exposure, and photographically processed according to the following processing conditions using the following developing solution and fixing solution. Thereafter, a haze test, a surface specific resistance test and an ash adhesion test were made.

The results are shown in Table 1.

Formulation of Developing Solution

| | |
|---|---|
| Hydroquinone | 25 g |
| 1-Phenyl-4,4-dimethyl-3-pyrazolidone | 0.4 g |
| Sodium bromide | 3 g |
| 5-Methylbenzotriazole | 0.3 g |
| 5-Nitroindazole | 0.05 g |
| Diethylaminopropane-1,2-diol | 10 g |
| Potassium sulfite | 90 g |
| Sodium 5-soulfosalicylate | 75 g |
| Sodium ethylenediaminetetraacetate | 2 g |

Made up to 1 liter by adding water.

The pH was adjusted to 11.5 using sodium hydroxide.

Formulation of Fixing Solution

| | |
|---|---|
| (Composition A) | |
| Ammonium thiosulfate (aqueous 72.5 wt. % solution) | 240 ml |
| Sodium sulfite | 17 g |
| Sodium acetate trihydrate | 6.5 g |
| Boric acid | 6 g |
| Sodium citrate dihydrate | 2 g |
| Acetic acid (aqueous 90 wt. % solution) | 13.6 ml |
| (Composition B) | |
| Pure water (ion-exchanged water) | 17 ml |
| Sulfuric acid (aqueous 50 wt. % solution) | 3.0 g |
| Aluminum sulfate (aqueous 8.1 wt. % solution in terms of $Al_2O_3$) | 20 g |

When the fixing solution was used, the above compositions A and B were dissolved in this order in 500 ml of water for preparing 1 l and put to use. This fixing solution had a pH of about 5.6.

(Processing conditions):

| Step | Temperature | Time |
|---|---|---|
| Developing | 40° C. | 8 seconds |
| Fixing | 35° C. | 8 seconds |
| Washing | Room temperature | 10 seconds |

Evaluation of Antistatic Property: Ash Adhesion Test

In an environment of 23° C. and 20%RH, the emulsion side surface of the processed sample was rubbed several times with a rubber roller, and ashes of a cigarette ware brought close to the surface to examine whether or not the ashes were adhered to the surface. Evaluation was made according to the following:

A: No ashes adhere at all even when brought close up to a distance of 1 cm from the surface.

AB: Ashes adhere when brought close up to a distance of 1 cm to 4 cm from the surface.

C: Ashes adhere when brought close up to a distance of 4 cm to 10 cm from the surface.

D: Ashes adhere even when kept at a distance of 10 cm or more.

There is no problem in practical use when evaluated as A or B.

Measurement of Surface Specific Resistance

Measured at an applied voltage of 100 V and in an environment of 23° C., 20% RH, using a teraohmmeter VE-30, manufactured by Kawaguchi Denki K.K.

Haze test: The above obtained sample was developed without exposure to light and haze was measured using a turbidimeter Model T-2600DA, manufactured by Tokyo Denshoku K.K., and was indicated in %.

EXAMPLE 2

A sample was prepared in the same manner as in Example 1, except that subbing coating solution B-3 was replaced with subbing coating solution B-4 to form the subbing second layer. Evaluation was made in the same manner as in Example 1.

Subbing Coating Solution B-4

| | |
|---|---|
| Gelatin | 10 g |
| Compound A | 0.4 g |
| Compound B | 0.1 g |
| Silica particles with an average particle diameter of 3 μm | 0.1 g |
| Polyvinylbenzenesulfonicacid | 3 g |
| Powder P2 | 5 g |

Made up to 1 liter by adding water.

EXAMPLE 3

A sample was prepared in the same manner as in Example 1, except that subbing coating solution B-3 was replaced with subbing coating solution B-5 to form the subbing second layer. Evaluation was made in the same manner as in Example 1.

Subbing coating solution B-5

| | |
|---|---|
| Gelatin | 10 g |
| Compound A | 0.4 g |
| Compound B | 0.1 g |
| Silica particles with an average particle diameter of 3 μm | 0.1 g |
| Polyvinylbenzenesulfonicacid | 2 g |
| Powder P2 | 3 g |

Made up to 1 liter by adding water.

EXAMPLE 4

A sample was prepared in the same manner as in Example 1, except that subbing coating solution B-3 was replaced with subbing coating solution B-6 to form the subbing second layer. Evaluation was made in the same manner as in Example 1.

Subbing Coating Solution B-6

| | |
|---|---|
| Gelatin | 10 g |
| Compound A | 0.4 g |
| Compound B | 0.1 g |
| Silica particles with an average particle diameter of 3 μm | 0.1 g |
| Polyvinylbenzenesulfonicacid | 3 g |
| Powder P2 | 1.5 g |

Made up to 1 liter by adding water.

EXAMPLE 5

A sample was prepared in the same manner as in Example 1, except that subbing coating solution B-3 was replaced with subbing coating solution B-7 to form the subbing second layer. Evaluation was made in the same manner as in Example 1.

Subbing Coating Solution B-7

| | |
|---|---|
| Gelatin | 10 g |
| Compound A | 0.4 g |
| Compound B | 0.1 g |
| Silica particles with an average particle diameter of 3 μm | 0.1 g |
| Polyvinylbenzenesulfonicacid | 3 g |
| Powder P2 | 0.5 g |

Made up to 1 liter by adding water.

Comparative Example 1

A sample was prepared in the same manner as in Example 1, except that subbing coating solution B-3 was replaced with subbing coating solution B-0 to form the subbing second layer. Evaluation was made in the same manner as in Example 1.

Subbing Coating Solution B-0

| | |
|---|---|
| Gelatin | 10 g |
| Compound A | 0.4 g |
| Compound B | 0.1 g |
| Silica particles with an average particle diameter of 3 μm | 0.1 g |

Made up to 1 liter by adding water.

TABLE 1

| | Volume fraction (%) | Surface*2 specific resistance | Dust adherence test | Haze test |
|---|---|---|---|---|
| Example 1 | 26 | $2.5 \times 10^7$ | A | 3 |
| Example 2 | 8 | $1.8 \times 10^6$ | A | 2 |
| Example 3 | 5 | $1.2 \times 10^8$ | A | 2 |
| Example 4 | 2.5 | $6.5 \times 10^9$ | B | 2 |
| Example 5 | 0.8 | $9.8 \times 10^9$ | B | 2 |
| Comparative 1 | 0 | $9.5 \times 10^{13}$ | D | 2 |

*2Surface specific resistance (Ω/square)

As is apparent from Table 1, the photographic light-sensitive material of the invention shows an excellent transparency and a high antistatic property even in a low humidity.

What is claimed is:

1. A silver halide light-sensitive photographic material comprising a support and provided thereon, a subbing layer and a silver halide emulsion layer in that order, wherein said subbing layer contains in admixture a binder, metal oxide particles having a volume specific resistance of not less than $10^9$ Ω cm, and a conductive polymer, said metal being selected from the group consisting of Ti, Si and Al.

2. The photographic material of claim 1, wherein said metal oxide particles have a volume specific resistance of $10^9$ to $10^{16}$ Ω cm.

3. The photographic material of claim 1, wherein said metal oxide particles have an average particle diameter of not more than 1 μm.

4. The photographic material of claim 1, wherein said conductive polymer has a volume specific resistance of not more than $10^{13}$ Ω cm.

5. The photographic material of claim 1, wherein said metal oxide is selected from the group consisting of $Al_2(isoC_3H_7O)_3$, $Si_3Al_4O_{12}$, $TiO_2$, $Al_2O_3$ and $SiO_2$.

6. The photographic material of claim 1, wherein the content of said metal oxide particles in the subbing layer is 0.1 to 60% by volume.

7. The photographic material of claim 1, wherein the content of said metal oxide particles in the subbing layer is 0.5 to 30% by volume.

8. The photographic material of claim 1 wherein said conductive polymer is selected from the group consisting of polyvinyl benzene sulfonic acid, salts thereof, and polyvinyl benzyl trimethylammonium chloride.

* * * * *